US007359485B2

(12) United States Patent
Ohsawa

(10) Patent No.: US 7,359,485 B2
(45) Date of Patent: Apr. 15, 2008

(54) X-RAY GENERATING METHOD AND X-RAY GENERATING APPARATUS

(75) Inventor: Satoshi Ohsawa, 1-12-2, Otsutominami, Tsuchiura City, Ibaraki Pref. (JP)

(73) Assignees: Satoshi Ohsawa, Tsuchiura (JP); Noriyoshi Sakabe, Tsukuba (JP)

( * ) Notice: Subject to any disclaimer, the term of this patent is extended or adjusted under 35 U.S.C. 154(b) by 0 days.

(21) Appl. No.: 11/204,967

(22) Filed: Aug. 17, 2005

(65) Prior Publication Data

US 2006/0039535 A1 Feb. 23, 2006

(30) Foreign Application Priority Data

Aug. 20, 2004 (JP) ..... 2004-241301

(51) Int. Cl.
*H01J 35/14* (2006.01)

(52) U.S. Cl. ..... 378/138; 378/137

(58) Field of Classification Search ..... 378/137, 378/138, 129, 119, 121, 125
See application file for complete search history.

(56) References Cited

U.S. PATENT DOCUMENTS 4,130,759 A 12/1978 Haimson
4,389,572 A 6/1983 Hutcheon
4,392,235 A 7/1983 Houston
5,060,254 A * 10/1991 de Fraguier et al. ..... 378/136
5,680,432 A * 10/1997 Voss ..... 378/137
5,822,395 A * 10/1998 Schardt et al. ..... 378/137
6,091,799 A 7/2000 Schmidt
6,181,771 B1 * 1/2001 Hell et al. ..... 378/137
6,778,633 B1 * 8/2004 Loxley et al. ..... 378/113
2003/0058995 A1 3/2003 Kutshera et al.

FOREIGN PATENT DOCUMENTS

EP 0 127 983 A2 12/1984
GB 2 021 310 A 11/1979
JP A 11-144653 5/1999

* cited by examiner

*Primary Examiner*—Hoon Song
(74) *Attorney, Agent, or Firm*—Oliff & Berridge, PLC

(57) ABSTRACT

An electron beam with a circular cross section is flattened to form a flat electron beam with a flattened cross section. Then, the flat electron beam is irradiated onto a target, thereby generating an X-ray. Since the flat electron beam has high energy density, the X-ray can be generated in high intensity.

16 Claims, 4 Drawing Sheets

X-RAY GENERATING METHOD AND X-RAY GENERATING APPARATUS

BACKGROUND OF THE INVENTION

1. Field of the Invention

This invention relates to an X-ray generating method and an X-ray generating apparatus.

2. Description of the Background Art

In order to generate high intensity X-ray, it is required to irradiate high density electron beam onto a target. It is difficult, however, to generate a minute focal point onto the target from the high density electron beam because of the large repulsive forces of the electrons of the high density electron beam. In order to mitigate such a problem as not generating the minute focal point, it is proposed to enhance the accelerating voltage of the electrons, but in this case, the electrons are introduced deeply into the target so that the X-ray generated from the deep portions of the target is absorbed into the target and thus, the generating efficiency of the intended X-ray is lowered. When the accelerating voltage is enhanced, the cost of the X-ray generating apparatus may be increased because the X-ray generating apparatus must be insulated entirely.

SUMMERY OF THE INVENTION

It is an object of the present invention to provide a new X-ray generating method and apparatus whereby high intensity X-ray can be generated in high efficiency.

In order to achieve the object, this invention relates to a method for generating an X-ray, comprising the steps of:

flattening an electron beam with a circular cross section to form a flat electron beam with a flat cross section, and irradiating the flat electron beam onto a target, thereby generating an X-ray.

This invention also relates to an apparatus for generating an X-ray, comprising:

a flat electron beam-generating means for flattening an electron beam with a circular cross section to form a flat electron beam with a flat cross section, and a target for generating an X-ray by irradiating the flat electron beam thereon.

In the present invention, the flat electron beam with the flat cross section is irradiated onto the target, thereby generating the X-ray. Since the flat electron beam is configured such that the cross section of a normal electron beam with a normal circular cross section is flattened against the space charge of the electron beam, the cross section of the flat electron beam can be flattened and narrowed sufficiently even though the electron beam has a sufficient large energy. According to the present invention, therefore, the electron beam with small cross section and high energy density can be generated due to the flat electron beam. As a result, the intended high energy density electron beam can be irradiated onto the target, thereby generating the high intensity X-ray.

The flat electron beam can be generated, for example, by employing a pair of magnets which are opposite to one another such that a uniform magnetic field can be generated and passing the electron beam through the uniform magnetic field such that the electron beam can be at an angle except 90 degrees for the outlet, that is, the end surface of the space end of the pair of magnets.

The flat electron beam can be also generated, for example, by employing a pair of mixed type magnets and passing the electron beam through the mixed type magnets. The mixed type magnets can be made by separate magnets which are obtained by cutting symmetrically a rotational symmetric magnet by four. In this case, a pair of separate magnets opposing to one another are arranged such that the curved surfaces of the separate magnets are opposed one another.

As described above, according to the present invention can be provided the new X-ray generating method and apparatus whereby the high intensity X-ray can be generated in high efficiency.

BRIEF DESCRIPTION OF THE DRAWINGS

For better understanding of the present invention, reference is made to the attached drawings, wherein.

DESCRIPTION OF THE PREFERRED EMBODIMENTS

This invention will be described in detail with reference to the accompanying drawings.

Figure 1:
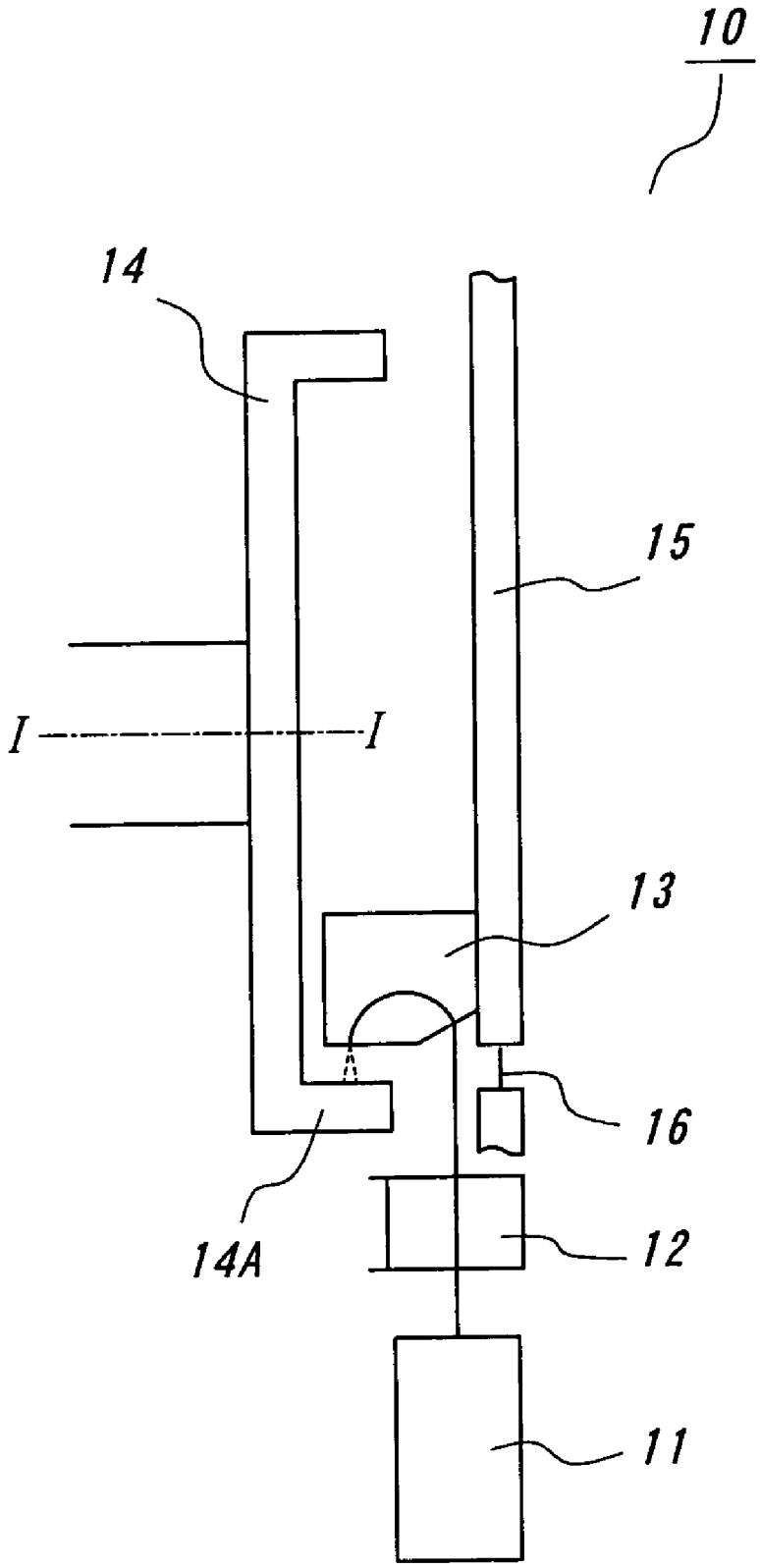
FIG. 1 is a structural view illustrating a main part of an X-ray generating apparatus according to the present invention.

FIG. 1 is a structural view illustrating a main part of an X-ray generating apparatus according to the present invention. The X-ray generating apparatus 10 includes an electron gun 11, an electromagnet 12, a deflecting magnet 13 as a flat electron beam generating means and a rotational target 14. The rotational target 14 is joined with a driving motor (not shown) via a driving shaft (not shown) such that the rotational target 14 can be rotated around the central axis I-I. The rotational target 14 is disposed in an airtight container 15, and the deflecting magnet 13 is attached to the inner wall of the airtight container 15. The interior of the airtight container 15 is evacuated to a given degree of vacuum, e.g., within a pressure range of $10^{-2}$ Pa-$10^{-4}$ Pa, preferably within $10^{-3}$ Pa-$10^{-4}$ Pa. Throughout the accompanying drawings, arrows designate traces of electron beam.

The electron beam emitted from the electron gun 11 is controlled such that the traveling direction of the electron beam is directed at the deflecting magnet 13 by the electromagnet 12. Then, the electron beam is passed through the deflecting magnet 13, so that the cross section of the electron beam is varied to flat shape from circular shape on the function as will be described below. The resultant flat electron beam is irradiated onto the inner side of the side wall 14A of the rotational target 14. In this case, a given X-ray is generated from the irradiating point of the rotational target 14, and taken out of an X-ray transparent window 16. The X-ray transparent window 16 may be made of Be foil.

Since the flat electron beam can be obtained by flattening the electron beam with circular cross section against the space charge of the electron beam, the flat electron beam can be flattened sufficiently and narrowed in cross section even though the flat electron beam has large energy. Therefore, the intended electron beam with minute cross section and high energy density can be obtained easily as the flat electron beam. As a result, when the flat electron beam is irradiated onto the rotational target 14, the intended X-ray with high intensity can be generated.

Figure 2:
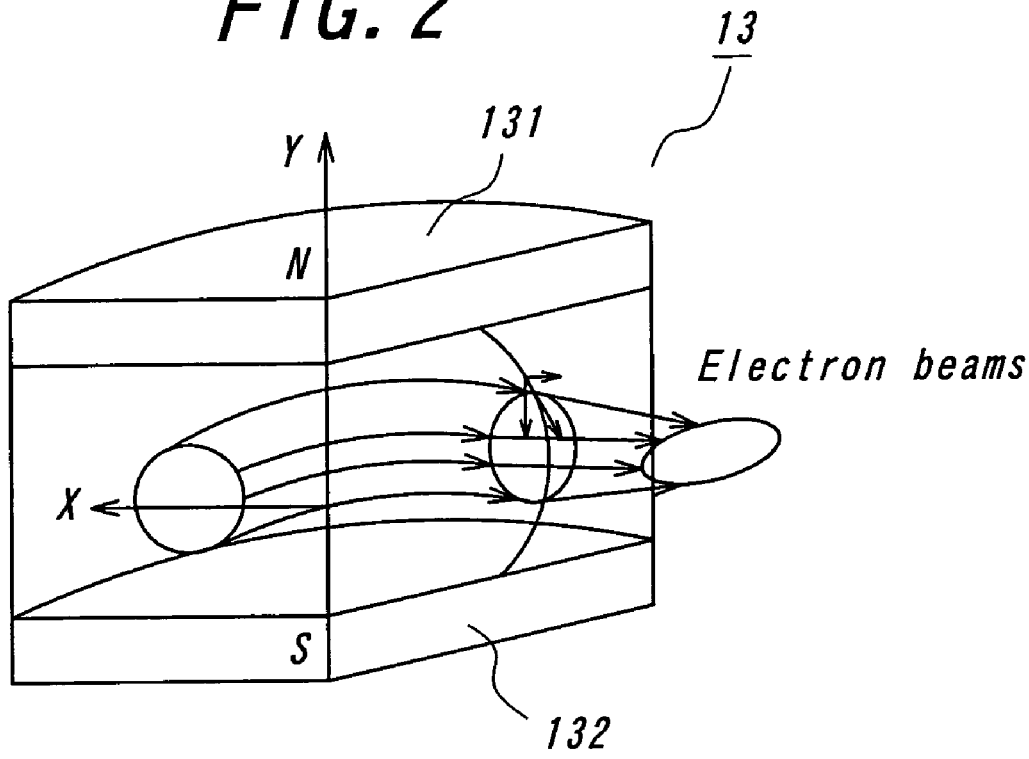
FIG. 2 is a structural view illustrating a deflecting magnet of the X-ray generating apparatus illustrated in FIG. 1.
Figure 3:
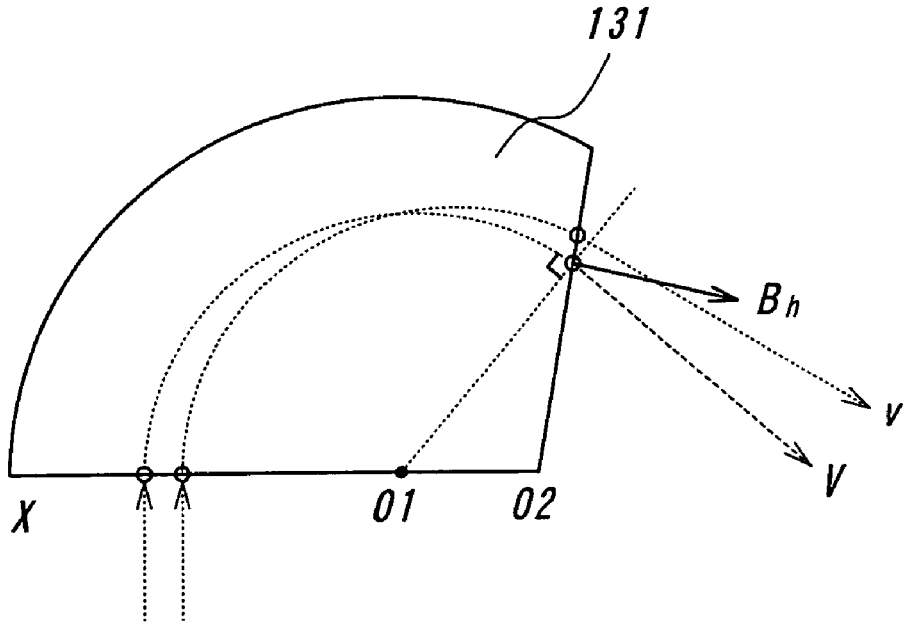
FIG. 3 is another structural view illustrating the deflecting magnet of the X-ray generating apparatus illustrated in FIG. 1.
Figure 4:
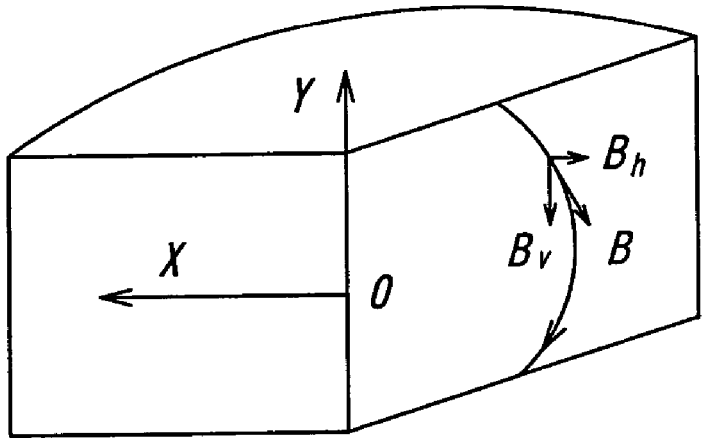
FIG. 4 is still another structural view illustrating the deflecting magnet of the X-ray generating apparatus illustrated in FIG. 1.

FIGS. 2-4 are structural views illustrating an embodiment relating to the deflecting magnet 13 of the X-ray generating apparatus illustrated in FIG. 1. In the deflecting magnet 13 illustrated in FIGS. 2 and 3, a pair of fan-shaped magnets 131 and 132 are arranged so as to be opposite to one another. In the deflecting magnet 13 illustrated in FIG. 2, the upper magnet 131 is a north pole, and the lower magnet 132 is a south pole. Therefore, a uniform magnetic field is generated vertically and downwardly between the magnets 131 and 132.

In this case, the electron beam is introduced between the fan-shaped magnets 131 and 132, and forced by the Lorentz forces directing at the rotational centers 01 and 02 because the deflecting magnet is designed such that the incident electron beams can have the rotational centers 01 and 02. As a result, the electron beam is passed through the fan-shaped magnets 131 and 132 along the fan-shaped side surfaces of the magnets 131 and 132.

On the other hand, as illustrated in FIG. 4, the magnetic field B is expanded outward from the end surface, that is, the outlet of the space formed by the fan-shaped magnets 131 and 132 so that a magnetic field component Bv parallel to the end surface and a magnetic field component Bh perpendicular to the end surface are generated from the magnetic field B. Then, as illustrated in FIG. 3, the electron beam is passed through the end surface of the space at a given angle except 90 degrees.

In the upper side (Y>0) of the symmetry plane between the fan-shaped magnets 131 and 132, since the magnetic field B is directed outward, the magnetic field component Bh becomes more than zero (>0). In the lower side (Y<0) of the symmetry plane, since the magnetic field component Bh becomes less than zero (<0). Therefore, if the velocity of the electrons of the electron beam is set to v, some electrons passing through the upper side of the symmetry plane are forced downward by the Lorentz forces originated from the magnetic field component Bh, and the other electrons passing through the lower side of the symmetry plane are forced upward by the Lorentz forces originated from the magnetic field component Bh. As a result, the electrons converges toward the symmetric plane, and thus, as illustrated in FIG. 2, the electron beam with a circular cross section is flattened, thereby generating the intended flat electron beam after the electron beam is passed through the fan-shaped magnets 131 and 132.

Figure 5:
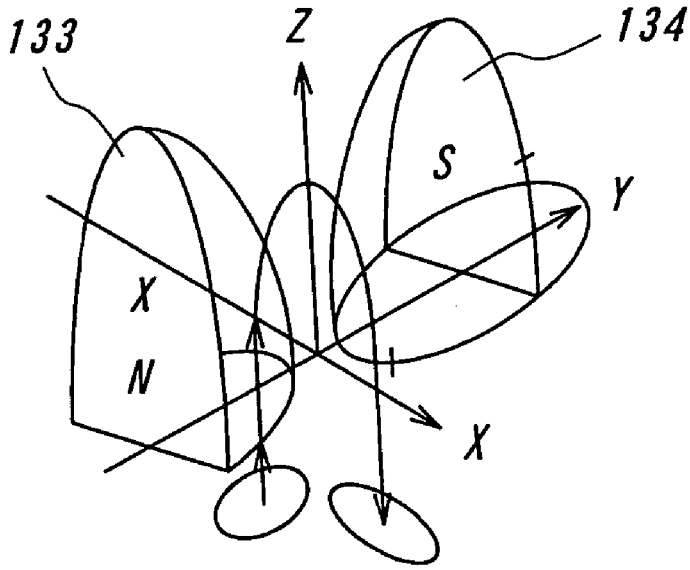
FIG. 5 is a structural view illustrating another deflecting magnet of the X-ray generating apparatus illustrated in FIG. 1.
Figure 6:
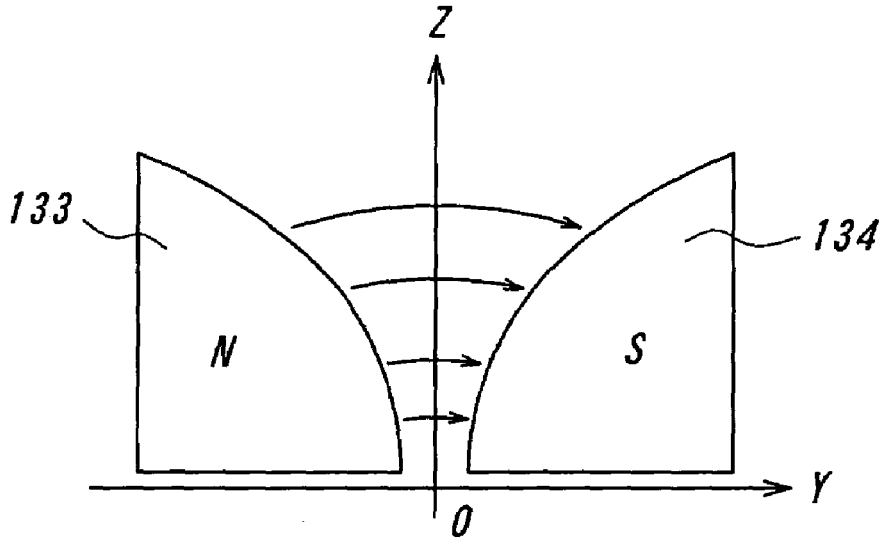
FIG. 6 is another structural view illustrating another deflecting magnet of the X-ray generating apparatus illustrated in FIG. 1.
Figure 7:
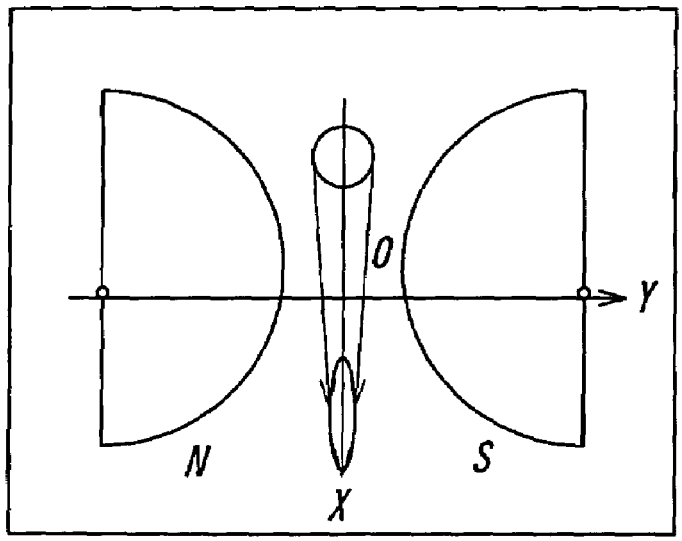
FIG. 7 is still another structural view illustrating another deflecting magnet of the X-ray generating apparatus illustrated in FIG. 1.

FIGS. 5-7 are structural views illustrating another embodiment relating to the deflecting magnet 13 of the X-ray generating apparatus illustrated in FIG. 1. In this embodiment, as illustrated in FIGS. 5 and 6, the deflecting magnet 13 includes a pair of mixed type magnets 133 and 134 which are disposed so that the curved surfaces of the magnets 133 and 134 are opposed one another. Each magnet 133 or 134 is made by cutting symmetrically a rotational symmetric magnet by four. In this embodiment, the left side mixed type magnet 133 is a north pole, and the right side mixed type magnet 134 is a south pole. Therefore, a given magnetic field is generated between the magnets 133 and 134 illustrated in FIG. 6. The electron beam is introduced between the magnets 133 and 134 from on the X-axis to the Z-axis, forced by the Lorentz force directing at the center, rotated around the Y-axis, and emitted outward from on the X-axis.

In this case, the magnetic field is expanded outward from the end surface of the space formed by the magnets 133 and 134 along the X-axis as illustrated in FIG. 4. As described above, therefore, some electrons passing through the right side (Y>0) of the symmetry plane of the magnetic field generated between the magnets 133 and 134 are forced to the left (Y<0) by the Lorentz forces originated from the magnetic field component Bh, and the other electrons passing through the left side (Y<0) of the symmetry plane of the magnetic field generated between the magnets 133 and 134 are forced to the right (Y>0) by the Lorentz forces originated from the magnetic field component Bh. As a result, the electrons converges toward the symmetric plane, and thus, the electron beam with a circular cross section is flattened, thereby generating the intended flat electron beam.

Since the flat electron beam has large energy density, the flat electron beam can heat the irradiating portions of the electron beam in the rotational target 14 up to a temperature near or more than the melting point of the target 14, thereby partially melting the target 14 when the flat electron beam is irradiated onto the target 14. As a result, the intended X-ray with high intensity can be generated high efficiency.

In the embodiment relating to FIG. 1, since the flat electron beam is irradiated onto the inner side of the inner wall 14A of the rotational target 14, the melting portions of the rotational target 14 can not be splashed outside by the centrifugal force generated when the rotational target 14 is rotated.

Although the present invention was described in detail with reference to the above examples, this invention is not limited to the above disclosure and every kind of variation and modification may be made without departing from the scope of the present invention.

In the above embodiment, although the rotational target is employed, another type of target may be employed. Moreover, although the fan-shaped magnet and mixed type magnet are exemplified as the flat electron beam-generating means, another type of magnet may be employed only if the object of the present invention can be realized.

The invention claimed is:

1. A method for generating an X-ray, comprising the steps of:

flattening an electron beam with a circular cross section to form a flat electron beam with a flat cross section so that the electron beam density of said electron beam is strengthened;

irradiating said flat electron beam onto a target, thereby generating an X-ray with higher intensity;

wherein said flat electron beam is made by passing said electron beam through a pair of mixed type magnets, and each said mixed type magnet is made by a separate magnet which is obtained by cutting a rotational symmetric magnet by four, and said pair of mixed type magnets are disposed so that curved surfaces of said mixed type magnets are opposed one another.

2. The generating method as defined in claim 1, wherein said flat electron beam is made by passing said electron beam through a magnetic field generated between a pair of magnets which are opposed one another so that said electron beam is passed through an end surface of a space formed by said magnets at a given angle except 90 degrees.

3. The generating method as defined in claim 2, wherein around said end surface of said space formed by said magnets, some electrons of said electron beam passing through an upper side of a central plane between said magnets are forced downward by Lorentz forces originated from said magnetic field, and the other electrons of said electron beam passing through a lower side of said central plane between said magnets are forced upward by Lorentz forces originated from said magnetic field, thereby generating said flat electron beam.

4. The generating method as defined in claim 1, wherein in between said pair of mixed type magnets, some electrons of said electron beam passing through a right side of a symmetry plane between said magnetic field generated between said pair of mixed type magnets are forced to the left by Lorentz forces originated from said magnetic field, and the other electrons of said electron beam passing through a left side of said symmetry plane between said magnets are forced to the right by Lorentz forces originated from said magnetic field, thereby generating said flat electron beam.

5. The generating method as defined in claim 1, wherein said target is a rotational target.

6. The generating method as defined in claim 5, wherein irradiating portions of said flat electron beam in said rotational target are heated to a temperature near or more than a melting point of said rotational target to be partially melted, thereby generating said X-ray from said rotational target.

7. The generating method as defined in claim 6, wherein said flat electron beam is irradiated onto an inner wall of said rotational target so that melted portions of said rotational target which are generated by irradiating said flat electron beam onto said rotational target are not splashed by a centrifugal force generated when said rotational target is rotated.

8. The generating method as defined in claim 1, wherein said target is disposed in an airtight container, and said X-ray is taken out of said airtight container via a given X-ray transparent film.

9. An apparatus for generating an X-ray, comprising:

a flat screen electron beam-generating means for flattening an electron beam with a circular cross section to form a flat electron beam with a flat cross section so that the electron beam density of said electron beam is strengthened; and a target for generating an X-ray with higher intensity by irradiating said flat electron beam thereon, wherein said flat electron beam-generating means is made by a pair of mixed type magnets so that said electron beam is passed through said pair of mixed type magnets, thereby generating said flat electron beam, and each mixed type magnet is made by a separate magnet which is obtained by cutting a rotational symmetric magnet by four, and said pair of mixed type magnets are disposed so that curved surfaces of said mixed type magnets are opposed one another.

10. The generating apparatus as defined in claim 9, wherein said flat electron beam-generating means is made by a pair of magnets which are opposed one another and generates a magnetic field therebetween so that said electron beam is passed through said magnetic field and an end surface of a space formed by said magnets at a given angle except 90 degrees.

11. The generating apparatus as defined in claim 10, wherein around said end surface of said space formed by said magnets, some electrons of said electron beam passing through an upper side of a central plane between said magnets are forced downward by Lorentz forces originated from said magnetic field, and the other electrons of said electron beam passing through a lower side of said central plane between said magnets are forced upward by Lorentz forces originated from said magnetic field, thereby generating said flat electron beam.

12. The generating apparatus as defined in claim 9, wherein in between said pair of mixed type magnets, some electrons of said electron beam passing through a right side of a symmetry plane between said magnetic field generated between said pair of mixed type magnets are forced to the left by Lorentz forces originated from said magnetic field, and the other electrons of said electron beam passing through a left side of said symmetry plane between said magnets are forced to the right by Lorentz forces originated from said magnetic field, thereby generating said flat electron beam.

13. The generating apparatus as defined in claim 9, wherein said target is a rotational target.

14. The generating apparatus as defined in claim 13, wherein irradiating portions of said flat electron beam in said rotational target are heated to a temperature near or more than a melting point of said rotational target to be partially melted, thereby generating said X-ray from said rotational target.

15. The generating apparatus as defined in claim 14, wherein said flat electron beam is irradiated onto an inner wall of said rotational target so that melted portions of said rotational target which are generated by irradiating said first electron beam onto said rotational target are not splashed by a centrifugal force generated when said rotational target is rotated.

16. The generating apparatus as defined in claim 9, wherein said target is disposed in an airtight container, and said X-ray is taken out of said airtight container via a given X-ray transparent film.

* * * * *